United States Patent [19]

Spitz

[11] 4,366,855

[45] Jan. 4, 1983

[54] SELF-CLEANING RECUPERATOR

[75] Inventor: Albert W. Spitz, Elkins Park, Pa.

[73] Assignee: Milpat Corporation, Glenside, Pa.

[21] Appl. No.: 238,978

[22] Filed: Feb. 27, 1981

[51] Int. Cl.[3] ..... F28G 9/00
[52] U.S. Cl. ..... 165/95
[58] Field of Search ..... 165/95, 119, 1

[56] References Cited

U.S. PATENT DOCUMENTS

| | | | |
|---|---|---|---|
| 1,916,337 | 7/1933 | Schmidt | 165/95 X |
| 2,049,720 | 8/1936 | Petzold et al. | 165/119 |
| 2,670,723 | 3/1954 | Clarkson | 165/95 X |
| 2,720,936 | 10/1955 | Beu | 165/95 X |
| 3,130,778 | 4/1964 | McColl | 165/95 X |
| 3,242,975 | 3/1966 | Kogan | 165/95 X |
| 3,412,786 | 11/1968 | Taylor | 165/95 X |
| 3,534,805 | 10/1970 | Ackerfeldt | 165/95 X |

FOREIGN PATENT DOCUMENTS

| | | | |
|---|---|---|---|
| 217865 | 3/1957 | Australia | 165/119 |
| 1275554 | 8/1968 | Fed. Rep. of Germany | 165/1 |

*Primary Examiner*—William R. Cline
*Attorney, Agent, or Firm*—John J. Simkanich

[57] ABSTRACT

A recuperator-type heat recovery apparatus may have a configuration for passing hot waste gases through an elongate, extended cyclone-type circulation path within a constricted area effecting the flow of the gases against a heat transfer surface and providing an extended retention time for radiating and conducting heat into this heat transfer surface and concurrently for changing the velocity of the gases resulting in a separation or fallout of heavier particles of dust and other matter entrained in the gases; a controlled introduction of abrasive particles operates to clean away buildup of contamination and dust deposits from all surfaces within the apparatus, the spent abrasive particles and dirt separating from the gases and being recovered.

8 Claims, 4 Drawing Figures

SELF-CLEANING RECUPERATOR

THE BACKGROUND OF THE INVENTION

This invention relates to industrial waste gas heat recovery devices and specifically to heat recuperators operative on hot waste gases heavy with particulate matter.

Heat recovery devices or recuperators have taken many forms depending upon the industries for which they have been used. A blast furnace pre-heat stove is a cylindrical structure containing a checker work of refractory brick. Waste blast furnace gases are passed through such a stove to heat the checker work. Ambient air is then passed through the hot stove to pre-heat the air before it is used in the blast furnace. Refractory checker work recuperators are also used in many other applications such as glass melting, and foundry soaking pit operations.

Ceramic tile recuperators and channel-type recuperators comprise banks of tubes, sometimes of uniform and sometimes of varying sizes. Often these tubes run between an input and output manifold. Hot gases pass through the tubes. Cold air is passed over the heated tubes for recouping the waste gas heat radiated therethrough.

Helical coil recuperators have been used in flue gas stacks. Such recuperators comprise a helically wound coil through which ambient air is passed for heating. The hot flue gases pass over this coil which is secured within the flow path of the hot gases. Radiation occurs through the walls of the ambient air-carrying coil.

One of the most popular types of stack or waste gas recuperators is the straight stack construction. This device passes waste gases through an inner tube while ambient air is passed through a surrounding jacket or tube. Heat from the waste gas is radiated through the separating wall to heat the ambient air.

A problem of scale, oxide and dirt build up occurs with each of these recuperators. This problem is magnified when the waste gases passing through the recuperator are particularly "dirty", i.e., heavily burdened with particulate matter. The dirt in the gas or the particulate matter entrained in the waste gas, deposits on the surfaces of the recuperator, thereby insulating the surfaces and substantially reducing the heat transfer capability, i.e., the capacity of the recuperator.

An object of the present invention is to provide a recuperator which is operable with particularly dirty waste gases having a cleaning function incorporated as part of the invention design for maintaining a stable heat transfer capacity for the recuperator.

Another object of the present invention is to provide a recuperator design where the waste gas pathway promotes the fall-out of heavier entrained particles for collection before the waste gas is scrubbed, filtered, etc.

Another object of the invention is to provide such a recuperator apparatus with the capability for leading of the waste gas passing through the recuperator with abrasive cleaning material, the recuperator having a forced waste gas pathway promoting separation of the entrained abrasive material, such separation causing an interaction with the surfaces of the recuperator whereby deposited dirt, scale and oxides are dislodged.

Another object of this invention is to provide an automatic recirculation of abrasive cleaning material through the recuperator.

A further object of this invention is to provide for an optional, automatic control of abrasive material concentration in the waste gas circulating through the recuperator.

SUMMARY OF THE INVENTION

The objects of this invention are realized in the recuperator-type heat recovery apparatus which passes hot waste gases through a cylindrical chamber along a helical pathway which causes the gases to remain in contact and scour the cylindrical walls of the chamber. An output duct extends vertically downwardly into the cylindrical chamber a substantial distance beyond the waste gas input opening thereof. Waste gases enter this chamber tangentially to its inner curved surface and are forced downwardly until there is a change in the linear velocity in order to exhaust through the output duct. Heavier particles entrained in the gases tend to separate and fall out with the reduction and change of velocity.

A heat exchange jacket surrounds the outside of the cylindrical chamber. A cold air input opening and hot air output opening to this heat exchange jacket are positioned to assure a flow of tangential air in a helical pattern within the jacket.

A spent abrasive material and dirt bin is positioned below the cylindrical chamber which opens thereinto for the collection of spent abrasive material and dirt cleaned from the recuperator surfaces. The abrasive may be used on an intermittent basis or recirculated.

Additional piping is utilized for recirculating collected abrasive material into the incoming hot waste gas for assuring a circulation of abrasive particles through the recuperator.

Additional abrasive material may be introduced into the waste gas prior to its entrance into the recuperator. This abrasive material may be introduced from a separate abrasive storage bin.

An optional automatic controller may monitor the temperature difference between the waste gas entering and exiting the recuperator for controlling the addition of abrasive particles to the waste gas circulating through the recuperator.

DESCRIPTION OF THE DRAWINGS

The features, advantages and operation of the recuperator-type, heat recovery apparatus invention will be more readily understood from a reading of the following detailed description of the invention in conjunction with the accompanying drawings in which like numerals refer to like elements and in which.

DETAILED DESCRIPTION OF THE INVENTION

Figure 1:
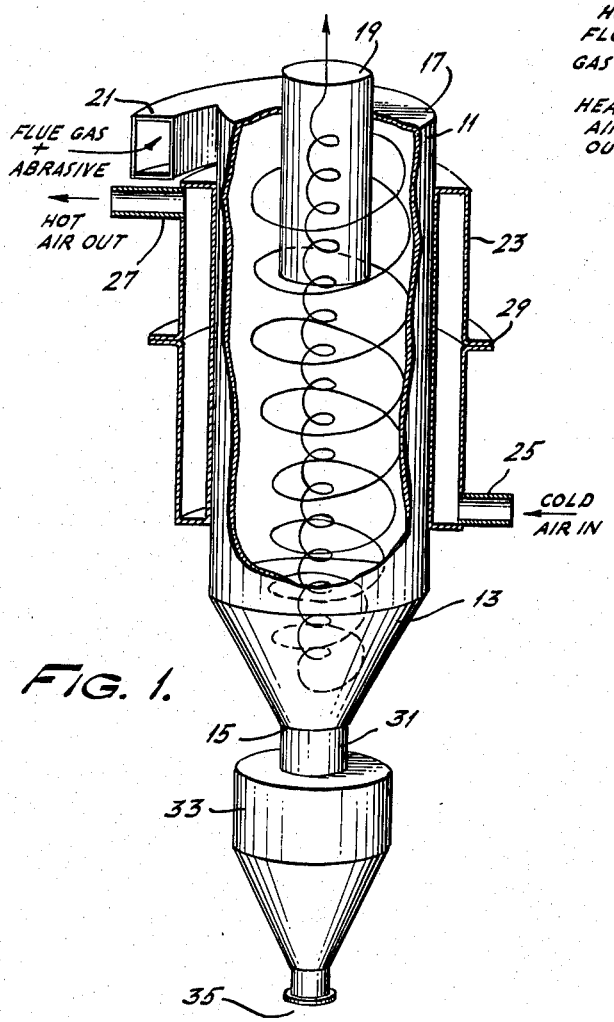
FIG. 1 shows a longitudinal, partial-sectional view of the structure and cyclone operation of the recuperator invention.

A self-cleaning waste gas recuperator type heat recovery apparatus includes a cylindrically shaped heat transfer structure, FIG. 1. A cylindrically-shaped swirl chamber 11 has a conical bottom 13 truncated at a reduced diameter opening. The swirl chamber 11 has a closed flat top 17 through which extends an outlet duct 19. The outlet duct 19 has its gas entry or input end positioned at about the mid-height of the cylindrical chamber 11. The exact location of the input end of this output duct 19 may be altered as a function of the flow dynamics (velocity, flow rate, pressure) of the gases within the chamber 11. However, in most instances it is desirable that the output duct 19 is positioned, concentrically, along the longitudinal axis of the cylindrical swirl chamber 11.

Hot flue gases enter the top of the cylindrical chamber 11 tangentially to the inner surface of this chamber through an elongate, cross-section, curved, tangential input passageway 21 which enters the side wall of the chamber 11 at the top thereof.

A heat transfer jacket 23 surrounds the outside of a substantial portion of the cylindrically shaped chamber 11. This heat transfer jacket 23 is also cylindrically shaped with a cold air input opening 25 at the bottom and a heated air output opening 27 at the top. These air openings 25, 27 each, respectively, enter and exhaust the jacket 23 in a tangential manner. Ambient air passes over the outside of the cylindrical chamber 11 in a helical fashion, from the bottom of the jacket 23 to the top.

The transfer jacket 23 may include one or more expansion joints 29 as needed as a function of operating temperatures and materials of construction.

A short duct 31 leads from the conical bottom opening 15 to an abrasive material and dust collector 33. Collector bin 33 can be rectangularly or cylindrically shaped with a pyramidal or conical bottom, respectively, leading to an output opening 35.

Figure 2:
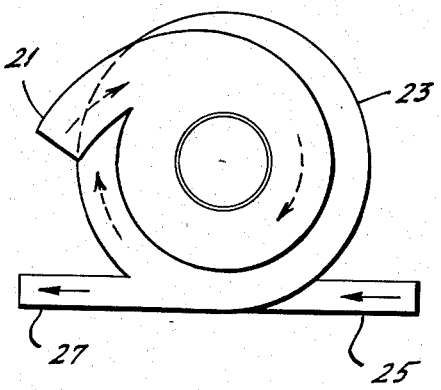
FIG. 2 shows a top view taken as shown in FIG. 1, showing the tangential position of the waste gas entry and tangential position of the heat exchange jacket input and output.

The tangential construction of the openings to the swirl chamber 11 and heat transfer jacket 23 are appreciated from the top view of the apparatus as shown in FIG. 2. Here the helical passageways of both the waste gases and circulated ambient air which is heated.

Figure 3:
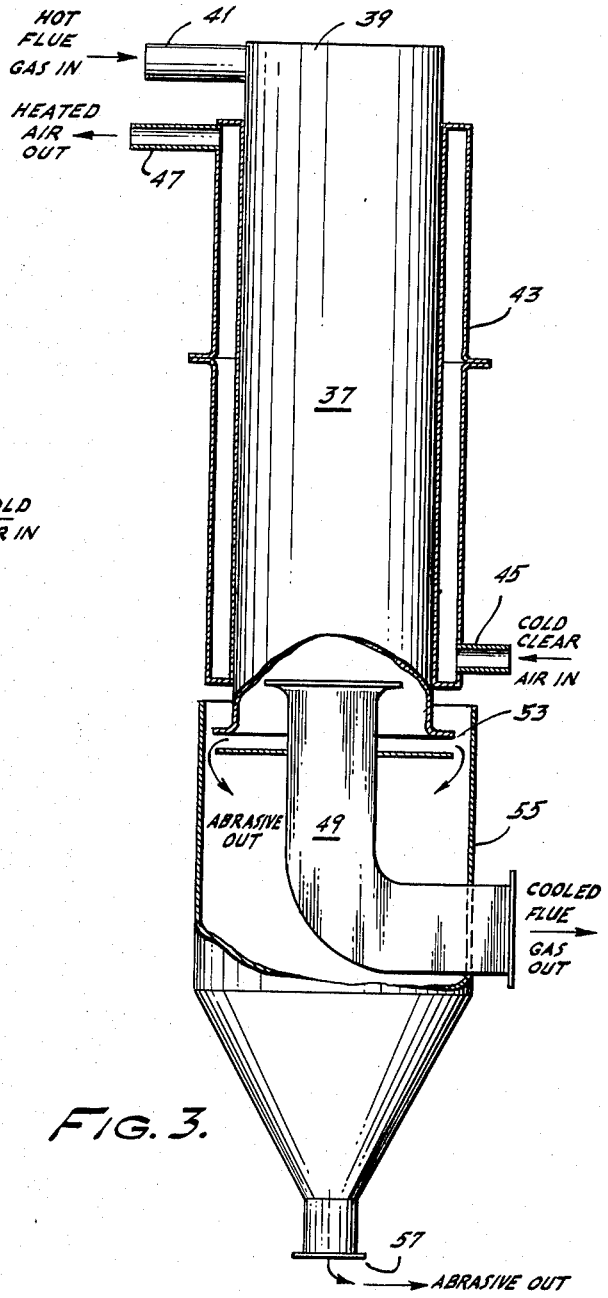
FIG. 3 shows an alternate embodiment to the heat transfer apparatus of FIG. 1 in longitudinal, partial-section, whereof the cyclone swirl chamber and the dust and abrasive collection chamber have been modified.

The heat transfer structure of FIG. 1 can be modified as shown in the alternate embodiment of FIG. 3. The cyclone swirl chamber 37 is cylindrically shaped throughout its length and has a completely enclosed top 39. An input duct 41 of similar size and shape to that of FIG. 1 is tangentially positioned to bring hot waste gases into the swirl chamber along the inside of the wall of that chamber 37. The hot gases are forced downwardly while traveling in a circle to create a helical path creating the cyclone swirling action within the chamber 37.

A cylindrically shaped jacket 43 forms the cold air heat transfer plenum extending about the cylindrical outside walls of the swirl chamber 37. A cold air input opening 45 and output opening 47 are positioned to tangentially access the transfer jacket at its bottom and top areas, respectively.

An output pipe 49 extends downwardly and then off-to-the-side from the bottom of the swirl chamber 37. A disk shaped bottom plate 51 is positioned about the input opening of the outlet pipe 49 and at a distance from the end of the cylindrical side walls of the chamber 37. This disk shaped plate 51 forms the bottom of the swirl chamber 37 and provides an annular space or opening 53 in the side wall of the chamber 37 through which spent abrasive material and dust particles may fall to a collector bin 55 below.

The collector bin 55 extends above the abrasive material discharge opening 53 and is cylindrically shaped with a conical or otherwise tapering bottom to an outlet opening 57.

Hot waste gases entering either the swirl chamber 11 or swirl chamber 37 of the embodiments of FIG. 1 and FIG. 3, respectively, is forced into a cyclone-type helical pathway. With the principal embodiment, FIG. 1, these gases forced to change direction whereby the linear velocity of the gas changes causing a fallout of heavy abrasive particles and heavy entrapped dust particles. These particles drop through to the respective collector bin 33, 55 below. Abrasive particles loaded into the waste gases abrade the walls of the respective swirl chambers 11, 37 to clean or remove scale, dirt and oxide buildup. The larger particles of this scale, dirt and oxide fall through to the respective collector bin 33, 55 along with the abrasive cleaning material. As such, the cleaning material (abrasive material) chosen must be compatible with the particulate in the gas and vice versa as larger pieces of the particulate become part of the abrasive cleaning material eventually as well as a size which will be removed by the apparatus. Smaller or minute particles are carried out of the recuperator with the waste gas. Typically, abrasive material of the 100 micron to 0.25 inches and above size are used. Dust particles of the 0.5 micron through 10 micron size typically are carried away with the waste gases. The choice of these sizes may be made as a function of velocity and flow dynamics of the gases through the recuperator and the caking characteristics of the particulate matter in the gas. Cut backs in volume, flow rate and pressure effect the operation of the abrasive material and entrained particulate matter as they pass through the recuperator.

The recuperator of the subject invention can operate with reverbatory furnaces, blast furnaces and other types of equipment in the melting and smelting of metals industries where waste gases leave the equipment at temperatures of 1600° F. to 2500° F. Sand, crushed slag and blasting grit are among materials which can be used as the abrasive materials.

Figure 4:
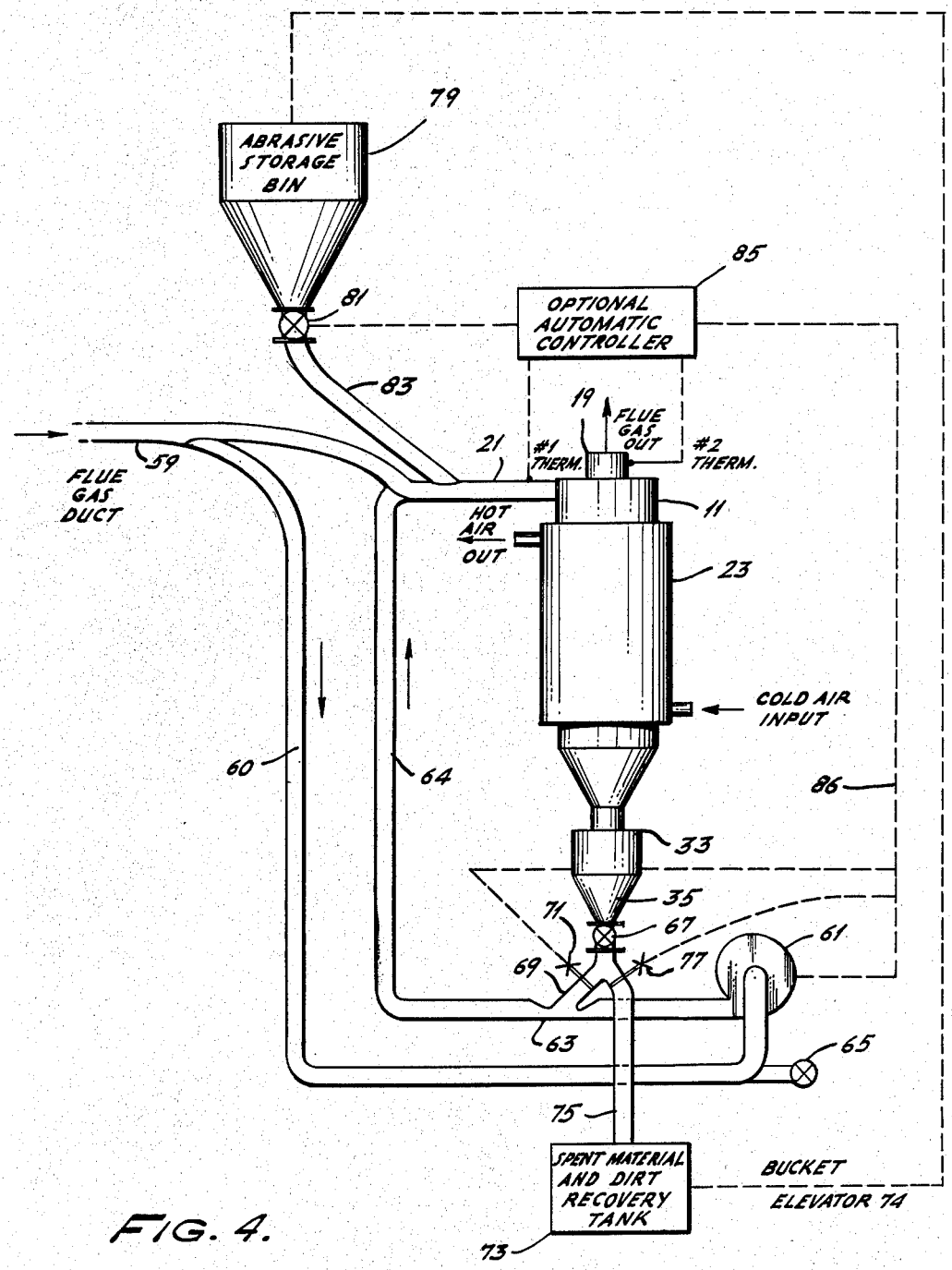
FIG. 4 shows the self-cleaning recuperator system including the waste gas piping for recirculating collected spent abrasive, as well as automatic control of abrasive density in the waste gas as a function of recuperator performance.

FIG. 4 shows the recuperator with its automatic recirculating abrasive material system. Here the recuperator, including its cylindrical chamber 11 and heat transfer jacket 23, is connected with the waste gas input passageway 21 tied to the flue gas duct 59. This duct 59 has a first takeoff pipe 60 for channeling a portion of the waste gas through a circulating fan 61 which pumps the gas past a venturi section 63 and back to the flue gas duct 59 downstream from its takeoff point through a return pipe 64. The fan 61 is electrically operated (motor driven) and is adjustable for fan rate in cubic feet per minute. A dilution air valve 65 is positioned on the intake to the fan 61 to bring in ambient air if the flue gas temperature is excessive for the structural materials of the system.

The output opening 35 from the collector 33 feeds a rotary valve 67 which is operated to bring the spent abrasive material and dirt from the collector 33 without disrupting the pressure and gas flow patterns within the recuperator apparatus. This rotary valve 67 includes a sealing operation to effect this operation.

A short duct 69 leads from the rotary valve to the ventury section 63. This short duct 69 includes a shut off valve 71.

The short duct 69 leading from the rotary valve 67 contains a second section which forks off from the first to lead to a spent abrasive material and dirt recovery tank 73. This second leg 75 includes its own shut off valve 77.

An abrasive storage bin 79 is connected to feed fresh abrasive to the flue gas duct 59 as it enters the waste gas input passageway 21. This abrasive material storage bin 79 has an output valve 81 which leads to a discharge duct 83 connected to the flue gas duct 59 at the recuperator input 21. The operation and opening of the abrasive material storage bin discharge valve 81 can be controlled by an automatic controller 85 which monitors the change in heat transfer efficiency of the recuperator. A bucket elevator 74 or equivalent means is used to transfer material from the recovery tank 73 to the abrasive storage bin 79.

The automatic controller 85 monitors the operation of the recuperator through the sensing of the temperature differences between the input waste gas and output waste gas temperatures. A first sensor 87 is positioned on the waste gas input passageway 21 while a second sensor 89 is positioned on the output duct 19. These sensors 87, 89 are connected as part of the controller 85 circuitry and operate as part of a comparator circuit when the controller 85 is set up for intermittent injection of additional abrasive material as a function of the fall-off of recuperator efficiency below a fixed threshold. The controller 85 is connected to the sensors 87, 89 for the control of the feed of abrasive material as a function of continual monitoring of recuperator heat transfer efficiency. The controller 85 can also be set to start and stop the system or operate it on a continuous or intermittent basis. A control line 86 from the controller 85 to the fan 61 and valves 71, 77 is used.

Many changes can be made in the above-described recuperator apparatus and many different embodiments of this invention can be made without departing from the scope and intent thereof. It is intended, therefore, that all matter contained in the above description or shown in the accompanying drawings be interpreted as illustrative and not be taken in a limiting sense.

What is claimed:

1. A self-cleaning recuperator comprising:

a cylindrically shaped swirl chamber having top and bottom end closures;

a hot gas inlet passageway entering said chamber through its cylindrical wall and tangentially thereto;

an outlet gas duct extending along the centerline of said chamber and exiting said chamber through the top closure thereof, said outlet duct extending downwardly a distance into said chamber beyond said hot gas inlet passageway entrance;

a cylindrical jacket surrounding said chamber cylindrical wall;

an inlet duct entering said jacket tangentially to said chamber wall;

an outlet duct exiting said jacket tangentially to said chamber wall;

means for introducing abrasive material into said hot gas inlet passageway; and a collector bin forming said bottom end closure.

2. The recuperator of claim 1 wherein said hot gas inlet passageway enters through said cylindrical wall of said chamber at the top thereof.

3. The recuperator of claim 1 wherein said abrasive material introducing means includes:

means for drawing abrasive material from said; collector bin and means for recirculating said drawn abrasive material into said hot gas inlet passageway.

4. The recuperator of claim 3 wherein said means for drawing abrasive includes:

a valve leading from said collector bin;

a venturi piping section connected to said valve outlet;

a fan connected to operate said venturi piping section; and means for drawing off hot gases from said hot gas inlet passageway and delivering them to said fan and for carrying away said drawn off hot gases and abrasive material from said collector bin to said hot gas inlet passageway.

5. The apparatus of claim 4 wherein said abrasive material introducing means includes an abrasive material supply connected to said hot gas inlet passageway; and also including an abrasive material and dirt recovery tank connected to said collector bin associated valve; and wherein said collector bin is conically shaped.

6. The apparatus of claim 5 also including means for transferring abrasive material from said recovery tank to said abrasive material supply.

7. The apparatus of claim 6 wherein said abrasive material transferring means includes a bucket elevator.

8. The apparatus of claim 5 also including:

means for monitoring the temperature difference between the hot gases into and out of said chamber; and means associated with monitoring means for controlling the amount of abrasive material delivered from said abrasive material supply.

* * * * *